US007431277B2

(12) United States Patent
Silberbauer

(10) Patent No.: US 7,431,277 B2
(45) Date of Patent: Oct. 7, 2008

(54) DEVICE FOR COLLECTING PRINTED SHEETS IN A CERTAIN SEQUENCE ASTRIDE AND ATOP ONE ANOTHER TO FORM A PRINTED PRODUCT

(75) Inventor: Günther Silberbauer, Oftringen (CH)

(73) Assignee: GRAPHA-Holding AG, Hergiswil (CH)

( * ) Notice: Subject to any disclaimer, the term of this patent is extended or adjusted under 35 U.S.C. 154(b) by 0 days.

(21) Appl. No.: 11/522,129

(22) Filed: Sep. 15, 2006

(65) Prior Publication Data

US 2007/0007714 A1 Jan. 11, 2007

(51) Int. Cl.
*B65H 39/02* (2006.01)

(52) U.S. Cl. ..... 270/52.26; 270/52.3; 270/52.16

(58) Field of Classification Search ..... None
See application file for complete search history.

(56) References Cited

U.S. PATENT DOCUMENTS 5,975,182 A 11/1999 Hartmann et al.

FOREIGN PATENT DOCUMENTS

JP 2000/218957 8/2000

*Primary Examiner*—Mark A Deuble
(74) *Attorney, Agent, or Firm*—Friedrich Kueffner

(57) ABSTRACT

A device for collecting printed sheets in a certain sequence astride and atop one another to form a printed product has a saddle-shaped support supplied by a sheet feeder with printed sheets. The saddle-shaped support is arranged above a conveying device transporting the printed products to a further processing step. The saddle-shaped support has a circulating traction mechanism and driving members connected to the circulating traction mechanism. The driving members act on the printed products to convey the printed products in a direction parallel to a conveying direction of the conveying device.

3 Claims, 1 Drawing Sheet

DEVICE FOR COLLECTING PRINTED SHEETS IN A CERTAIN SEQUENCE ASTRIDE AND ATOP ONE ANOTHER TO FORM A PRINTED PRODUCT

BACKGROUND OF THE INVENTION

1. Field of the Invention

The invention relates to a device for collecting printed sheets in a certain sequence astride and atop one another to form a printed product, wherein the device is comprised of a saddle-shaped support supplied by a sheet feeder with printed sheets and arranged above a conveying device for conveying the printed products to a further processing step.

2. Description of the Related Art

Such a device is described, inter alia, in European patent document 00 810 936.5. According to this prior art, the printed sheets are collected above a continuously circulating conveying device on a knife-shaped support in a certain sequence to form a printed product, and, by retracting the support, the collected printed sheets are dropped together onto the conveying device which supplies the printed products to a further processing device, for example, a stitching device.

This type of transfer of the printed products or the printed sheets collected on the support onto the conveying device requires an interruption of the supply of the printed sheets from the sheet feeder to the support, and such an interruption lasts for several processing cycles and thus causes processing delays at the conveying device.

SUMMARY OF THE INVENTION

It is an object of the present invention to provide a device for collecting printed sheets in a certain sequence astride and atop one another to form a printed product which device requires less time for the transfer of the printed products resting on the support so that processing at the conveying device can be accelerated or more time can be made available for ensuring greater processing reliability.

In accordance with the present invention, this is achieved in that the saddle-shaped support comprises driving members fastened on a circulating traction mechanism and acting on the printed products so as to convey them in a direction parallel to the conveying direction of the conveying device. This provides a process optimization.

Advantageously, the saddle-shaped support is provided on one side with a stop for a rearward alignment of the printed sheets of a printed product, and the drive motor of the driving members is configured to be reversible.

Preferably, the saddle-shaped support, when viewed in the conveying direction of the printed products, is connected with its upstream end so as to be fixed on the device frame. This provides the possibility of configuring the saddle-shaped support as a cantilever arm.

Expediently, the saddle-shaped support is arranged such that the printed products resting thereon overlap partially the conveying device so that a correct drop of the spread-apart printed products from the saddle-shaped support onto the conveying device is ensured.

In the following, the invention will be explained with the aid of one embodiment shown in the drawing, wherein reference is being had to the drawing specifically in regard to features not described in detail in the specification.

DESCRIPTION OF THE PREFERRED EMBODIMENTS

Figure 1:
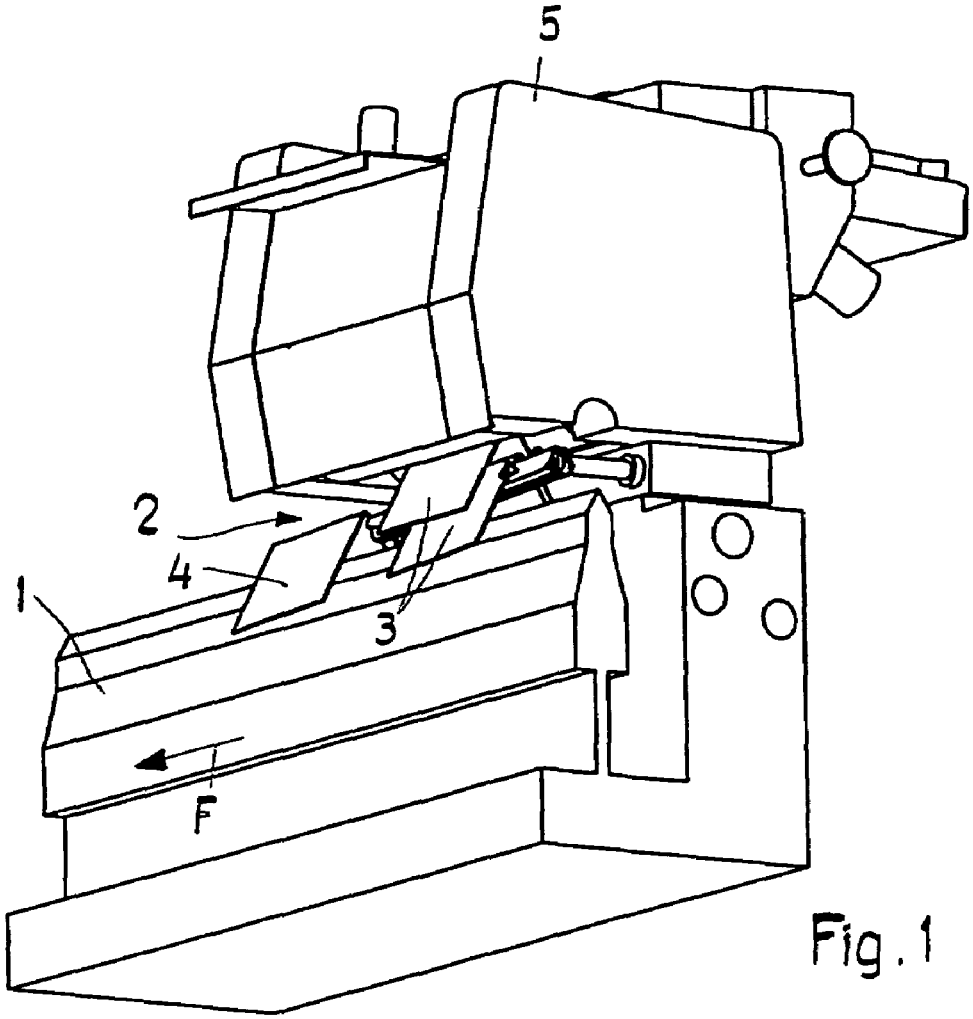
FIG. 1 shows a portion of a saddle-shaped support supplied by a sheet feeder with printed sheets and arranged above a conveying device.

FIG. 1 shows a portion of a schematically illustrated conveying device 1, for example, a collecting chain of a gatherer stitcher, on which the printed products 4, combined of printed sheets 3 on a saddle-shaped support 2 and dropped from the support 2 onto the conveying device 1, are transported. Prior to this, the printed sheets 3 are supplied from a sheet stack magazine in a cycled fashion by a sheet feeder arranged upstream of the saddle-shaped support 2, are opened, and dropped onto the saddle-shaped support 2. In the present embodiment, the printed sheets 3 are dropped in a certain sequence and number onto the saddle-shaped support 2, i.e., collected thereon to form the printed product 4, and are then transferred as a collated printed product 4 onto the conveying device 1 for further processing. FIG. 1 illustrates a printed product 4 which has been pushed off the saddle-shaped support 2 as well as a printed sheet 3 resting on the saddle-shaped support 2 and the next printed sheet 3 being supplied by the sheet feeder 5.

Figure 2:
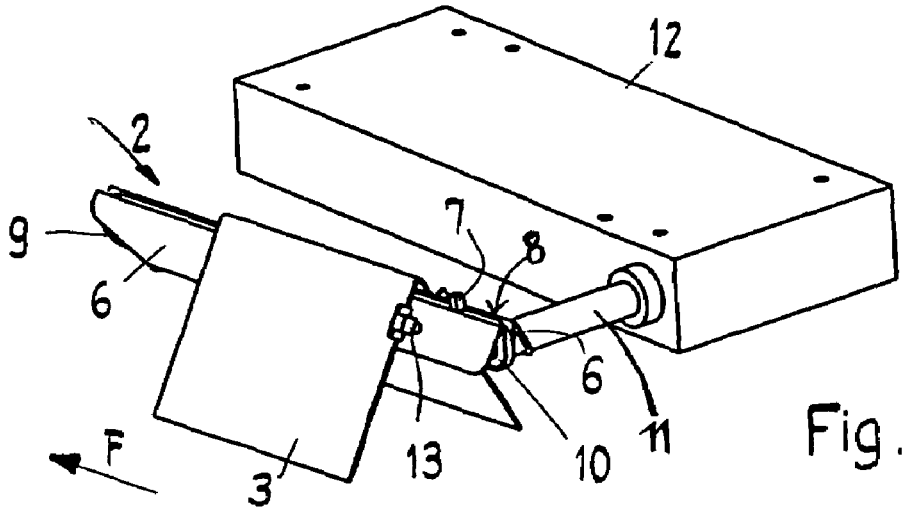
FIG. 2 shows the saddle-shaped support on an enlarged scale.

In FIG. 2, the saddle-shaped support 2 is illustrated with its important components. It is comprised of two lateral, downwardly slanted support surfaces 6 on which the first printed sheet 3 of a printed product 4 is positioned. One of several driving members 7, which are fastened on the circulating traction mechanism 8, is shown to project past a ridge which is formed by the upper ends of the support surfaces 6. The conveying direction of the printed product 4 illustrated by arrow F indicates the circulating direction of the driving members 7 about the guide rolls 9, 10 wherein the guide roll 10 is a driving roll and is connected to a drive motor (not illustrated in the drawing). The saddle-shaped support 2 is formed as a cantilever arm and is connected by means of a supporting member 11 with a frame part 12 at the end of the support 2 where the driving guide roll 10 is positioned. In the vicinity of the driving guide roll 10 a stop 13 is fastened on at least one support surface 6. The stop 13 is provided to precisely align the rearward edges of the bundled printed sheets 3 when carrying out a reversing movement of the drive motor driving the driving members 7.

While specific embodiments of the invention have been shown and described in detail to illustrate the inventive principles, it will be understood that the invention may be embodied otherwise without departing from such principles.

What is claimed is:

1. A device for collecting printed sheets in a certain sequence astride and atop one another to form a printed product, the device comprising:

an individual sheet feeder and a saddle-shaped support configured to be supplied by the individual sheet feeder with printed sheets, wherein the saddle-shaped support has a length, and wherein the saddle-shaped support is arranged over its entire length thereof above a conveying device transporting the printed products to a further processing step and is arranged between the sheet feeder and the conveying device;

wherein a distance between the saddle-shaped support and the individual sheet feeder is smaller than a width of freely suspended lateral parts of the printed products, whereby the freely suspended lateral parts of the printed products partially overlap the conveying device;

wherein the saddle-shaped support comprises a circulating traction mechanism and driving members connected to the circulating traction mechanism;

wherein the driving members act on the printed products to convey the printed products in a direction parallel to a conveying direction of the conveying device.

2. The device according to claim 1, wherein the saddle-shaped support comprises a stop arranged at one end of the saddle-shaped support, wherein the stop is configured to align the rearward edges of the printed sheets in the conveying direction of the conveying device, wherein the traction mechanism has a reversible drive motor.

3. The device according to claim 1, wherein the device has a device frame and wherein the saddle-shaped support has a rearward end when viewed in the conveying direction of the conveying device, wherein the rearward end of the saddle-shaped support is connected fixedly to the device frame.

* * * * *